US005306063A

United States Patent [19]

Higgins et al.

[11] Patent Number: 5,306,063

[45] Date of Patent: Apr. 26, 1994

[54] HANGER SUPPORT HANDLE

[76] Inventors: D. Campbell Higgins, 91 Reginald Crescent, Markham, Ontario, Canada, L3P 3T8; Ron Hodgins, 41 Norwich Street East, Suite 220, Guelph, Ontario, Canada, N1H 2G7

[21] Appl. No.: 990,033

[22] Filed: Dec. 14, 1992

[51] Int. Cl.[5] ..... A45C 13/26

[52] U.S. Cl. ..... 294/143; 294/159; 294/171

[58] Field of Search ..... 294/137, 141-143, 294/145, 159, 162, 163, 165, 170, 171; 16/114 R, 114 B; 211/113; 223/85, 88; 248/317, 339, 340

[56] References Cited

U.S. PATENT DOCUMENTS

| | | | |
|---|---|---|---|
| 1,468,848 | 9/1923 | Wear | 294/171 X |
| 3,207,397 | 9/1965 | Wilson | 294/141 |
| 3,554,418 | 1/1971 | Holmes | 294/142 |
| 3,670,937 | 6/1972 | Bradshaw | 294/171 |
| 3,680,752 | 8/1972 | Wilson | 294/171 |
| 3,705,674 | 12/1972 | Fisher | 294/165 |
| 3,804,310 | 4/1974 | Wheeler | 294/142 |
| 3,961,734 | 6/1976 | Threeton | 294/143 |
| 4,004,722 | 1/1977 | Olivier | 294/171 |
| 4,288,012 | 9/1981 | Doak | 294/143 |
| 4,923,235 | 5/1990 | Stewart | 294/141 |

FOREIGN PATENT DOCUMENTS

| | | | |
|---|---|---|---|
| 669745 | 1/1939 | Fed. Rep. of Germany | 294/171 |
| 2019831 | 6/1971 | Fed. Rep. of Germany | 294/137 |
| 3528037 | 2/1987 | Fed. Rep. of Germany | 294/171 |
| 3819580 | 12/1989 | Fed. Rep. of Germany | 294/171 |

*Primary Examiner*—Johnny D. Cherry

[57] ABSTRACT

The present invention relates to a support handle for supporting of clothes hangers by a user. The support handle engages the hooked portions of a clothes hanger and serves to separate the hanger from the hand of a user. This arrangement reduces pressure exerted by the hanger on a user's hand and allows convenient gripping of a number of hangers. The invention has particular application when carrying a number of garments on hangers, for example, picking up a number of garments from the dry cleaners. The support handle is of a simple form which is easily molded as a single piece.

8 Claims, 2 Drawing Sheets

FIG.1.
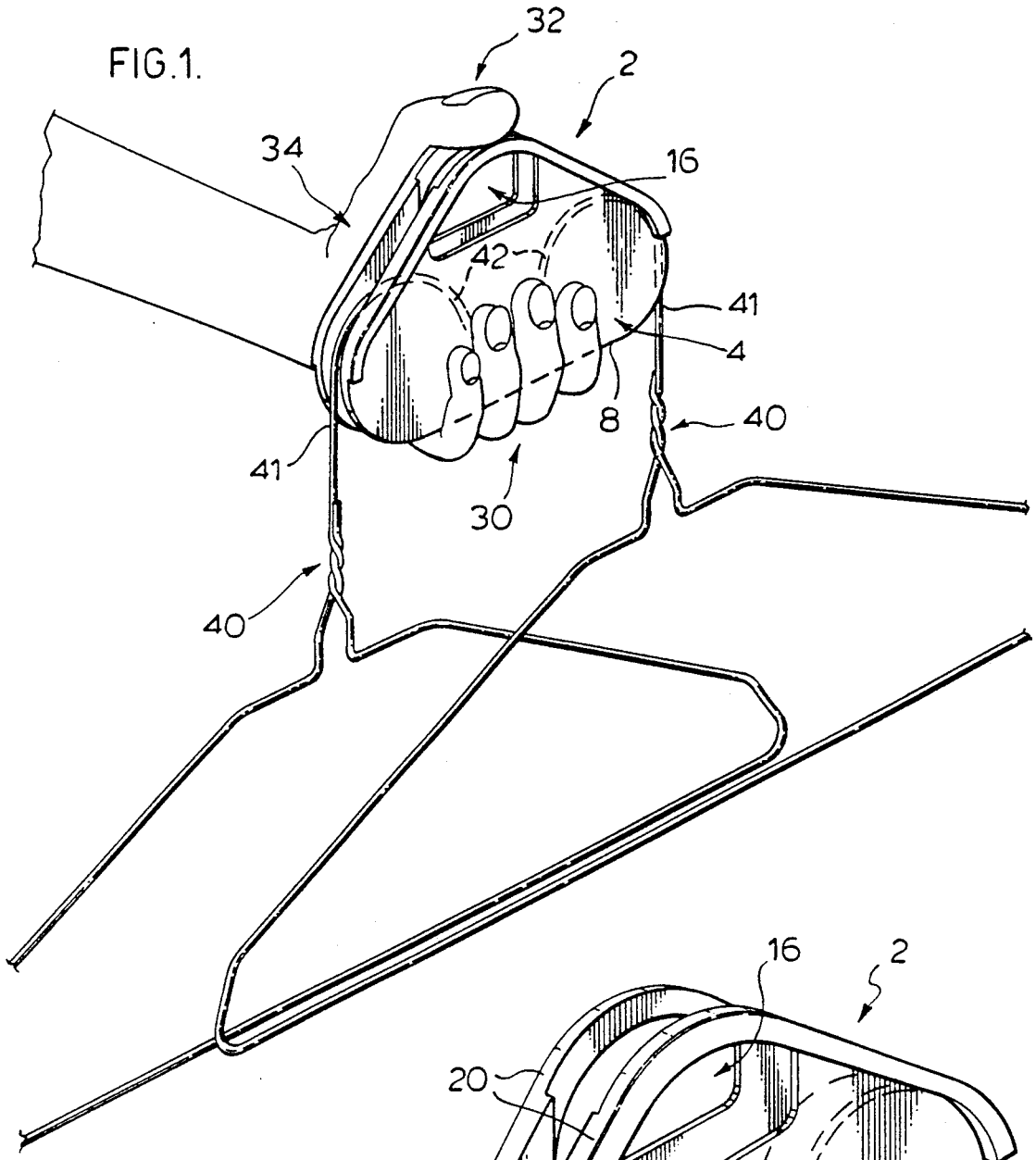
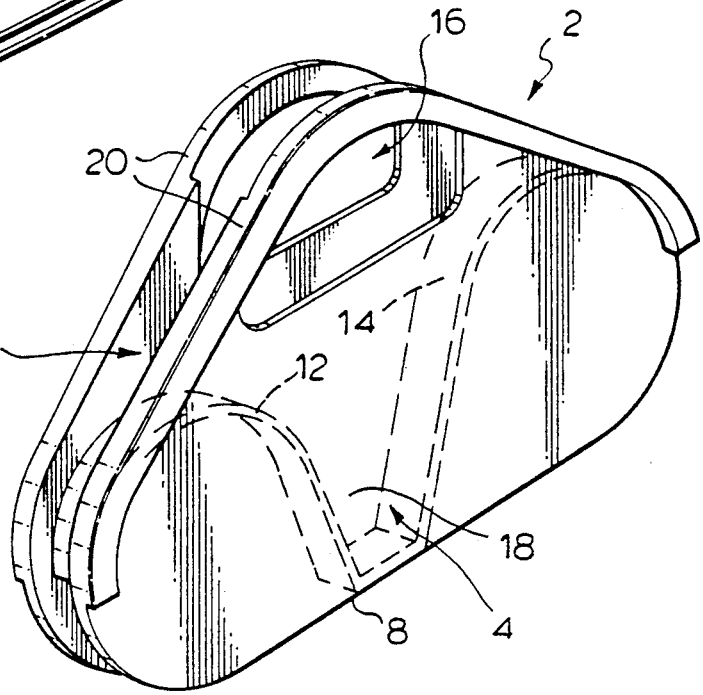
FIG. 2.

FIG. 3.
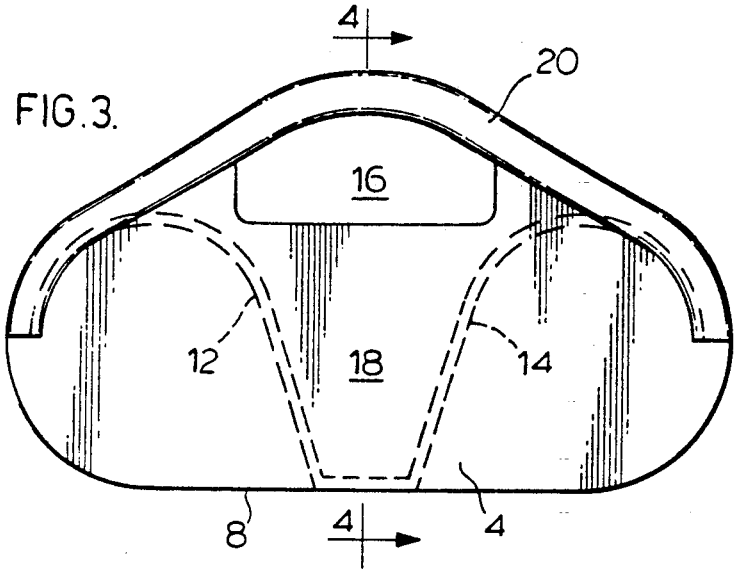
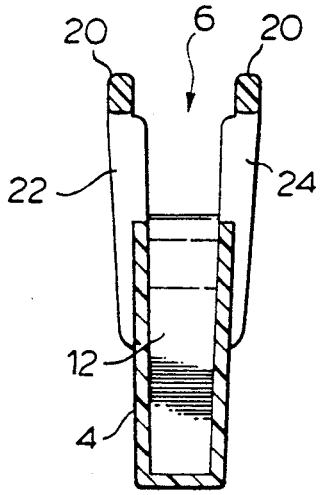
FIG. 4.
FIG. 5.
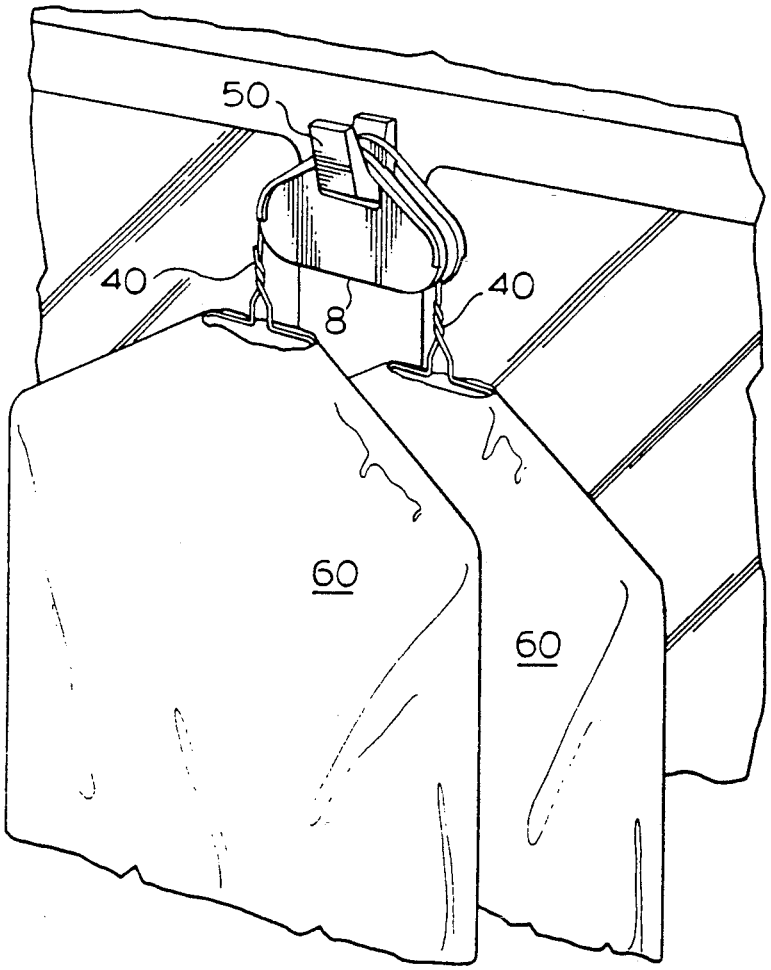

HANGER SUPPORT HANDLE

FIELD OF THE INVENTION

The present invention relates to a support arrangement for hangers. In particular, it relates to a support handle for receiving the hooked portions of clothes hangers.

BACKGROUND OF THE INVENTION

Typically, people take a number of garments to the dry cleaners for cleaning, and when they pick up the cleaned garments, they are provided on hangers and the hangers are often tied together below the neck portion of the hanger. With several garments on hangers, the weight is considerable and it is often uncomfortable to carry these cleaned garments by means of engaging the hooked portions of the hanger. This method of engaging the hangers concentrates the weight on two or three fingers of the user which causes discomfort. The other option is to fold the garments across one's arm; however, when the garments have just been cleaned and pressed, people are reluctant to carry them in this manner. There remains a need for a simple method of effectively supporting of clothes hangers to allow carrying of garments.

It can be recognized that there are other times when a number of garments on clothes hangers are carried and the handle arrangement disclosed in the application is useful and distributes forces in a comfortable and effective manner.

SUMMARY OF THE INVENTION

A support handle for engaging the hooked portions of hangers, according to the present invention, comprises a base with a slotted area for receiving a hooked end portion of a hanger and engaging the same for suspension of the hanger from the base. The base has a lower finger grip for grasping of the base by a user, such that the base receives the hooked portions of the hangers and separates the hooked portions from directly engaging a user's hand which is supporting the base.

According to an aspect of the invention, the support handle has opposed support structures in the slotted area, with each opposed support structure being designed for supporting hooked end portions of clothes hangers for suspension of the hangers to the side of the base closest to the support structure. This results in the hangers on the opposed support structures also being opposed, with the free end of the hooked portions of the hangers located in a central area of the base.

With the support handle, it is possible for the user to engage the finger grip lower surface of the base, with the thumb of the hand of the user closing the upper top slot. In this way, hangers which are received in the support handle remain therein, as they are trapped between the opposed support structures and the now closed slotted area.

BRIEF DESCRIPTION OF THE DRAWINGS

Preferred embodiments of the invention are shown in the drawings, wherein:

FIG. 1 is a perspective view of the support handle supporting opposed hangers;

FIG. 2 is a perspective view of the support handle;

FIG. 3 is a side view of the support handle;

FIG. 4 is a cross section taken along line 4—4 of FIG. 3; and

FIG. 5 is a perspective view of the support handle engaging a stationary garment hook.

DETAILED DESCRIPTION OF THE PREFERRED EMBODIMENTS

The support handle 2 has a base 4 and a slotted area 6. The slotted area is upwardly increasing, such that it is wider at the top and somewhat narrower adjacent the bottom of the base. The handle includes a lower finger grip area 8 whereby a user's fingers wrap about the lower surface of the base 4 and partially extend on either side of the base.

Interior to the base 4 are opposed support structures 12 and 14. These support structures are designed to engage the hooked portion of hangers and to locate the free end of the hooked portion in the interior central recess 18 of the base 4. The hangers are maintained in this position as they are trapped between the opposed side extensions 22 and 24. The opposed relationship of the hangers can be seen in FIG. 1 and FIG. 5. It should be noted that the neck portions 41 of the hangers 40 are located on either side of the support structures, and thus, the fingers, generally shown as 30, are free and a user can pass four fingers between the hangers for engaging the finger grip area, generally shown as 8. This lower finger grip area is thus isolated from the free end of the hooked portions of the hangers, as these are captured within the central recess. The finger grip area effectively distributes the weight or forces to the fingers and avoids high load concentration which can otherwise lead to discomfort. As shown in FIG. 1, the fingers 30 engage the base on either side thereof and the thumb, shown as 32, can engage the top opening slotted area 6. In FIG. 1, as shown, the thumb is across the top surface; however, in most cases, the fleshy part of the palm of a user adjacent the thumb and the thumb will override and close the top surface of the slotted area 6.

The support handle also includes a hanging port 16 provided in each of the side extensions 22 and 24 of the base 4. The side extensions are generally above the opposed support structures 12 and 14. The upper surfaces of these side extensions are reinforced to define the reinforced upper edge 20. The reinforced upper edge overlies the hanging port 16. The hanging port is used to locate the support handle on a garment hook, typically shown as 50 in FIG. 5 (for example a garment hook provided in a car).

As shown in FIG. 1, the handle support arrangement has captured the free end of the hooked portions 42 of the hangers 40 within the handle and a center gap is provided between the opposed necks of the supported hangers. This center gap allows a user to position his finger in the gap and engage the support handle. The handle is preferably of a size to allow the user to also close the upper slotted area merely by engaging the handle in the most convenient manner, typically with the thumb and/or fleshy part of the palm closing the slot. Thus, the user, in engaging the handle, ensures that the garment supporting hangers are not easily displaced from the support handle. This retention of the received hangers 40 in the support handle is also accomplished when they are placed on a garment hook, as shown in FIG. 5. The garment hook 50 passes through the port and serves to limit the upward removal of the hooked portions from the support handle. Therefore, in most circumstances, the supported hangers will be retained within the handle portion.

The area of the base between the sides of the support handle and below the support surfaces 12 and 14 is open to reduce material and allow convenient moulding. Similarly, the area above the opposed support structures 12 and 14 is open and is of increasing width to allow a moulding tool to easily pass in and out of this area, which is necessary for the forming operation. Furthermore, this increasing width serves as a guide for receiving the hooked portion of hangers. Therefore, the structure does not have a substantial amount of material and the material is appropriately located to provide the necessary strength, such as the additional material provided at the reinforced upper edge 20, as shown in FIGS. 2, 3 and 4.

The support handle is preferably manufactured by a split tool where the two halves of the tool touch each other or "kiss off" to create the hanging port 16.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A support handle for supporting the hooked ends of opposed hangers within the support handle, said support handle comprising:

a lower finger grip edge of a length to be engaged by the fingers of one hand;

opposed sidewalls extending upwardly from said finger grip edge to define a top open slot therebetween, said sidewalls extending in a length of said finger grip edge;

two opposed hanger support structures located within said slot at opposite ends of said handle, each hanger support structure being adapted to support a hooked segment of a hanger in said slot with a free end of the hooked segment located in a central recess, said central recess being located between said sidewalls and above said finger grip edge.

2. A support handle as claimed in claim 1 wherein said handle is manufactured as a single piece.

3. A support handle as claimed in claim 1 including a recess provided in said opposed sidewalls adjacent a top edge thereof, said recess being of a size to allow suspension of said handle from a garment hook.

4. A support handle as claimed in claim 3 wherein said slot has a narrow top opening which is closed by the thumb and palm of a user engaging the handle in a support position.

5. A support handle as claimed in claim 4 wherein said slot increases in width from a bottom position to a top position.

6. A support handle as claimed in claim 2 wherein each opposed hanger support structure is a curved segment of a shape generally corresponding to the curve of a hooked portion of a conventional hanger.

7. A support handle as claimed in claim 1 wherein each hanger support structure is a curved segment between said sidewalls, which curved segment forms part of a bottom of said slot.

8. A support handle as claimed in claim 7 wherein each curved segment terminates at a position adjacent one edge of said handle and substantially above said lower finger grip edge.

* * * * *